United States Patent [19]

DeMarco

[11] Patent Number: 4,609,362

[45] Date of Patent: Sep. 2, 1986

[54] NON-SONIFEROUS POWER DRIVE FOR UNDERWATER VEHICLES

[75] Inventor: Michael DeMarco, Middletown, R.I.

[73] Assignee: The United States of America as represented by the Secretary of the Navy, Washington, D.C.

[21] Appl. No.: 510,539

[22] Filed: Jul. 5, 1983

[51] Int. Cl.[4] ..... F42B 19/01

[52] U.S. Cl. ..... 440/75; 440/81; 114/20.2; 74/191

[58] Field of Search ..... 440/75, 6, 80, 81; 416/128, 129; 192/65; 74/191, 192, 193; 114/20 A

[56] References Cited

U.S. PATENT DOCUMENTS 2,501,936 3/1950 Gayer ..... 74/191 X 4,282,774 8/1981 Van der Lely ..... 74/191 X

FOREIGN PATENT DOCUMENTS 852812 10/1952 Fed. Rep. of Germany ..... 416/128

*Primary Examiner*—Sherman D. Basinger

*Attorney, Agent, or Firm*—Robert F. Beers; Arthur A. McGill; Prithvi C. Lall

[57] ABSTRACT

The system provides propulsion of an underwater vehicle without the need for noise producing gears or internal combustion engines. Variable speed of two impellers is automatically controlled from a single hydraulic piston regardless of depth, as is the horizontal and vertical attitude. Upright stability of the vehicle is held by controlling the speed of one impeller versus the other also using a single hydraulic piston. Since the speed controlling element allows output speed adjustments from zero to maximum, efficiency of the battery powered prime mover is high. The motor is allowed to come up to full high operational speed under no load conditions (zero output speed) developing vast amounts of kinetic energy through centrifugally forced contact rollers. This energy becomes available for the supply of peak power without taxing the prime mover, while continuing to reestablish the spent kinetic energy during periods of low power output. The system is suitable for utilizing digital control inputs that can feasibly be supplied by radio control through an antenna external to the system.

3 Claims, 12 Drawing Figures

NON-SONIFEROUS POWER DRIVE FOR UNDERWATER VEHICLES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to the propulsion and control system of a torpedo. The present design is simpler, has fewer moving components and is more efficient than my previous inventions, Variable Speed Reducing and Torque Transmitting System, U.S. Pat. No. 4,411,172 dated Oct. 25, 1983; U.S. Pat. No. 4,392,443 dated July 12, 1983, Electro-Pneumatic Hydraulic Control Systems; and U.S. Pat. No. 4,360,348 dated Nov. 23, 1982, Underwater Vehicle Porting System. All three applications were filed Feb. 20, 1981.

(2) Description of the Prior Art

In my previous inventions, supra, each of two impellers is driven by one of two sets of four satellite rollers rotating at relatively high speeds. The two sets of rollers are driven by a single rotating input. The net speed of each set is approximately four time the speed of the input member. The control of each impeller is independent of the other such that a dual control system is required. To increase or decrease the speed of the impellers in unison, positive or negative hydraulic pressure is required at both controls. To increase the speed of one impeller while decreasing the other requires positive pressure at one control and negative pressure at the other. There is some ambiguity when switching the hydraulic supply because of the possibility of overshooting positive or negative pressure which can result in both being on simultaneously. This condition tends to deteriorate the reserve available supply of hydraulic fluid.

The porting system is also dual control and the previously mentioned ambiguity is a source of drain on the reserve available supply of hydraulic fluid in much the same fashion. Furthermore, the ports are not strategically oriented. They are located perpendicular to seawater flow in an area where flow pressure is only slightly reduced.

The electrical motor with its required brushes is necessarily located remote from the impellers. Valuable space is sacrificed and the required long shaft extension for driving both sets of satellite rollers can be a source of dynamic instabilities.

SUMMARY OF THE INVENTION

It is a general object of the present invention to provide improved systems for propelling and controlling a torpedo. It is a further object to utilize most or all of the power generated by the prime mover to propel the torpedo in normal level flight without taxing the primary power plant during periods of acceleration, during climbing maneuvers and during periods of excessive demand for auxiliary power. These and other objects of the invention and various features and details of construction and operation will become apparent from the specification and drawings.

These are accomplished in accordance with the present invention by providing a gearless low noise power drive for underwater propulsion and control of marine vehicles. The system includes a D.C. motor that drives a pair of counter-rotating impellers through variable speed members. Each variable speed member drives both impellers. The rotational velocity of each impeller is altered by a control system that includes the positioning of the speed members by a piston. The rotational velocity of the impellers is a function of the positioning of the speed members and the speed ratioing techniques that apply is that of a simulated epicyclic gear train.

An electro-pneumatic-hydraulic system complex provides control for the counter-rotating impellers, a roll control system, a pitch control system, azimuth control system and a porting system. Each system has a piston that is controlled by a valve that has a choice of passing either of two hydraulic pressures. The valve is electrically controlled by detection equipment.

DESCRIPTION OF THE PREFERRED EMBODIMENT

Figure 1:
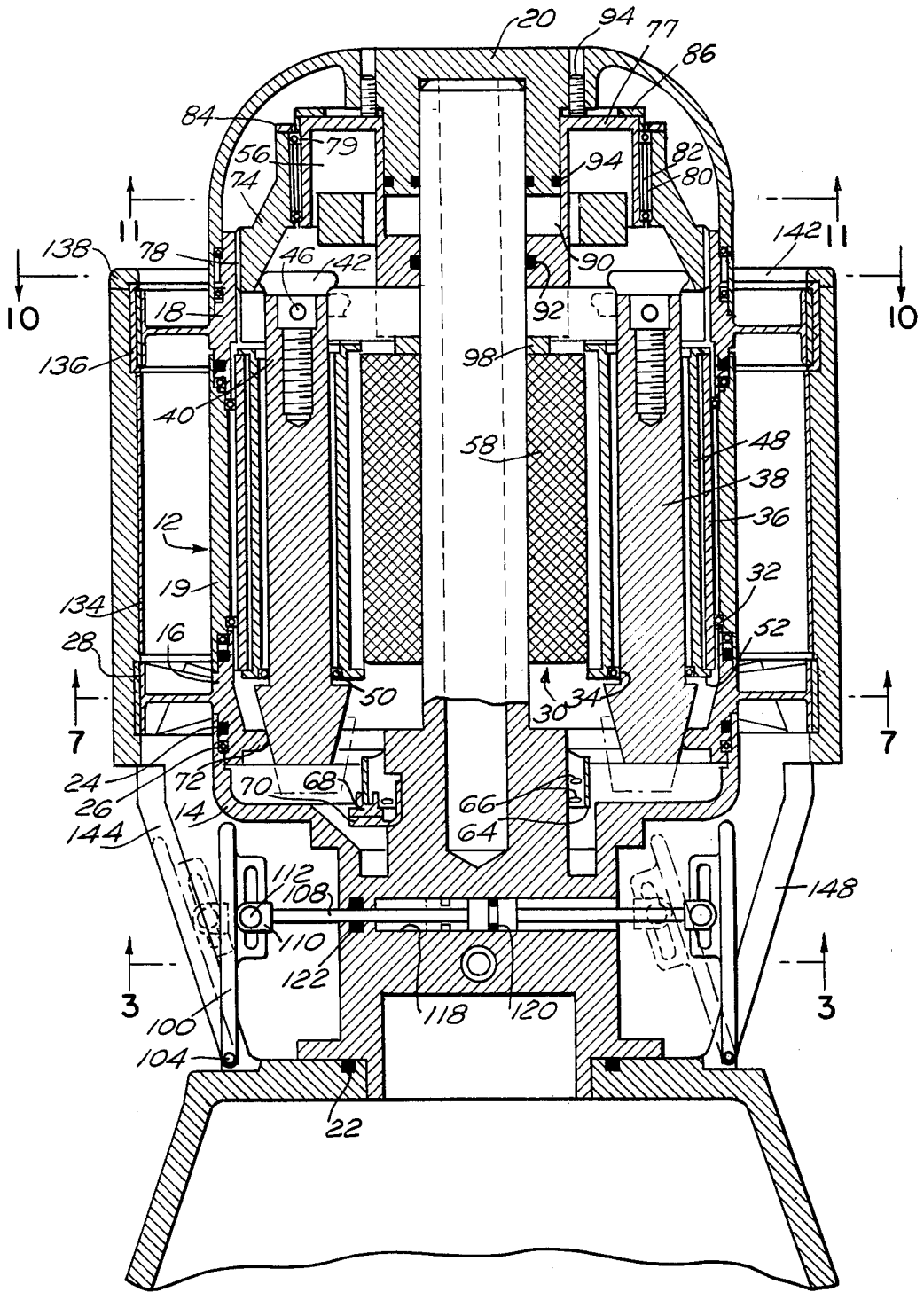
FIG. 1 is a sectional view of the power drive and control systems of the present invention taken along the line 1—1 of FIG. 3.
Figure 2:
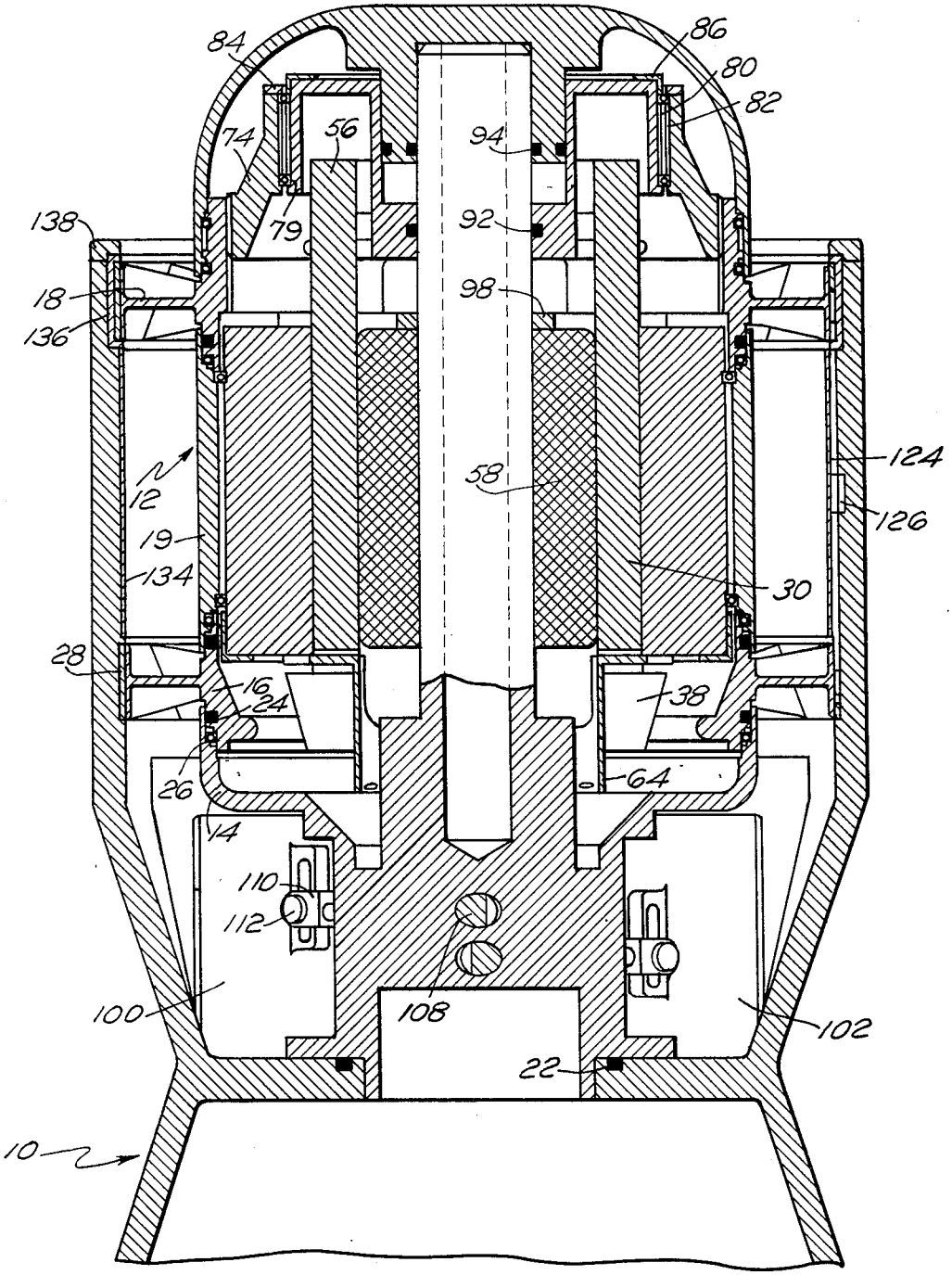
FIG. 2 is a sectional view of the power drive and control systems of the present invention taken along the line 2—2 of FIG. 3.
Figure 3:
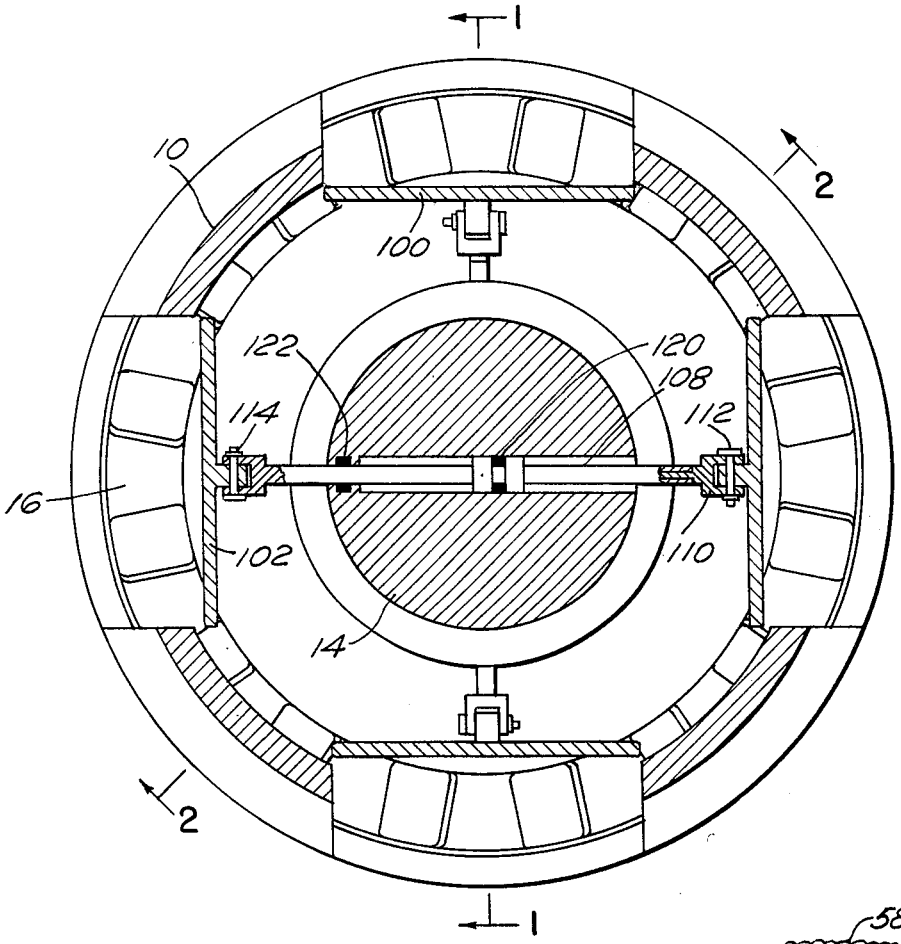
FIG. 3 is a cross-sectional view emphasizing the porting system of the present invention taken along the line 3—3 of FIG. 1.

Referring now to the figures there is shown a system with an outer housing 10 that is attached to an underwater vehicle (not shown) and inner water sealing enclosure 12. The inner water sealing enclosure 12 comprise an inner housing 14, impellers 16 and 18, intermediate coupling 19 and end cap 20. Sealing at the interface between the outer housing 10 and the inner housing 14 is effected by O-ring 22. Sealing between both sides of impellers 16 and 18, and inner housing 14 are accomplished by dynamic seals 24. Impellers 16 and 18 are free to rotate within the housing components by means of ball bearings 26 and outer journal bushing 28.

The major moving component within the inner enclosure 12 is the field of the motor 30. Motor 30 is supported by ball bearings 32 which in turn are restrained by loading collar 34. The rotating components including a rotor 36 containing four satellites 38 are assembled from two parts 40 and end roller 42, that are joined together by threads 44 and secured by pin 46. The satellites 38 are free to rotate within inserts 48 by means of staked in ball bearings 50 which in addition to radial support allows the satellites 38 freedom of motion in the fore and aft direction. The four inserts 48 are restrained torsionally by rotor 36 and also restrained laterally by flange bearings 52. However, the four inserts 48 are free to move radially outward under the centrifugal forces supplied due to the high speed rotation of the rotary field. The torque necessary to rotate the rotor 36 is supplied by two imbedded permanent magnets 56 that are acting within the flux generated by armature winding 58, an integral part of fixed inner housing 14. Mounted on rotor 36 is a drum 64 with two channels of perforations 66 at its outer edge. The perforation 66 rotate past a two channel light emitting diode phototransistor 68 that is mounted on bracket 70, that in turn is mounted on inner housing 14. The perforations 66 interrupt light as they rotate past the light emitting diode 68 creating sixteen digital pulses in one channel and four pulses in the other during each revolution of the field. The pulses are utilized for switching the polarities of the windings of armature 58.

Other moving parts of the system include interim member 74 which is spline coupled to impeller 18 at location 78 where necessary driving torque is supplied. Interim member 74 is free to rotate around cylinder housing 77 by means of ball bearings 79 which are held separated by spacers 80 and 82 and are retained by loading rings 84 and 86. Interim member 74 is also free to move fore and aft under the force created by the fore and aft motion of cylinder housing 77. The direction of force depends upon the applicaton of positive or negative hydraulic pressure within the cylinder cavity 90. End cap 20 secured to inner housing 14 by screws (not shown) along with O-rings 92 and 94 made up the balance of components that form cavity 90. Setscrews 96 permit final adjustments to cylinder housing 77 in order to make allowances for possible manufacturing eccentricities or assembly misalignments. Spacer 98 provides a stop that limits the forward travel of cylinder housing 77 to within safe limits.

As part of the porting system and attached to outer housing 10 are two pairs of baffle plates 100 and 102 which are secured by four pins 104 and positioned by two activators 106. Each activator 106 is made up of two pistons 108 with each piston 108 having an end fitting 110 held in place by a pin 112 and snap ring 114. Each piston 108 positions a pair of baffles 116 in oppositiion to each other, as shown in FIG. 1. The direction selected is dependent upon the application of positive or negative hydraulic presssure to two cylinder cavities 118 which are machined into inner housing 14 and sealed by O-rings 120 and 122.

Figure 7:
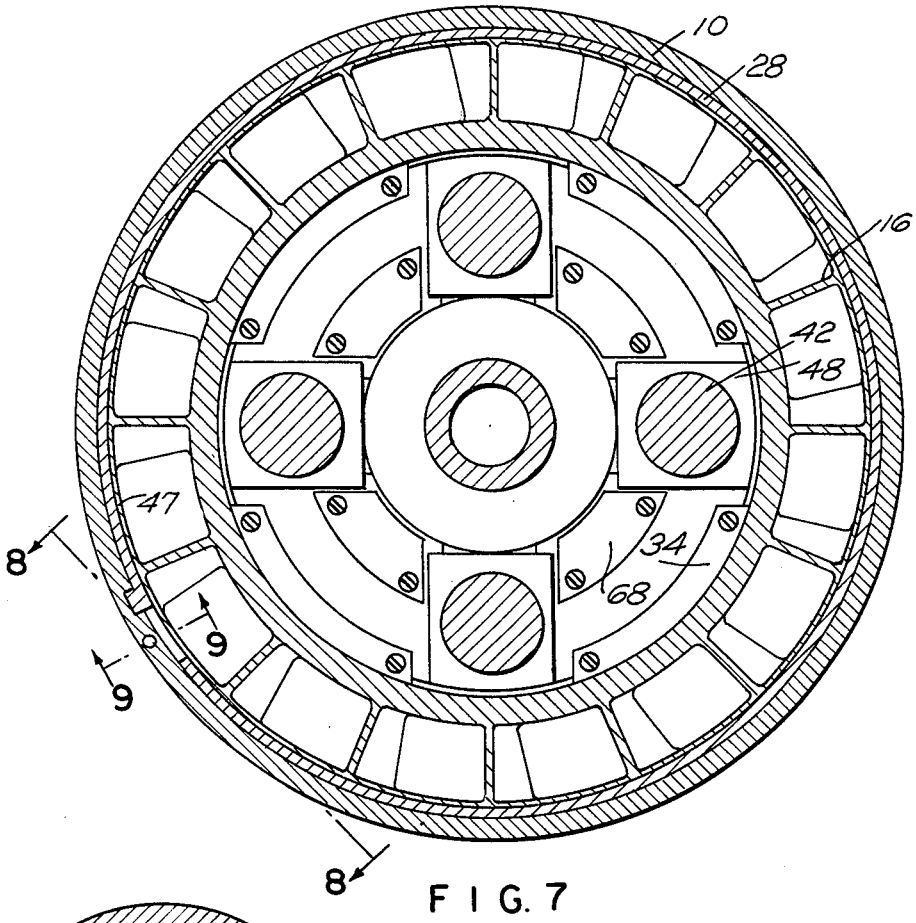
FIG. 7 is a cross-sectional view emphasizing the forward impeller and associated systems of the present invention taken along the line 7—7 of FIG. 1.
Figure 8:
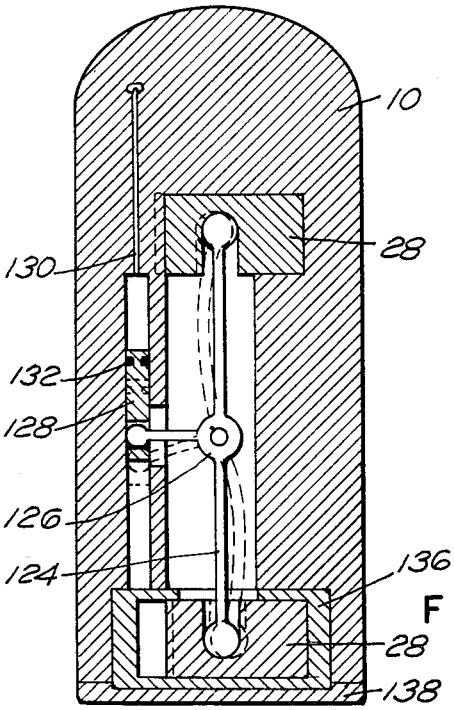
FIG. 8 is a sectional view emphasizing impeller control components of the present inventioh taken along the line 8—8 of FIG. 7.
Figure 9:
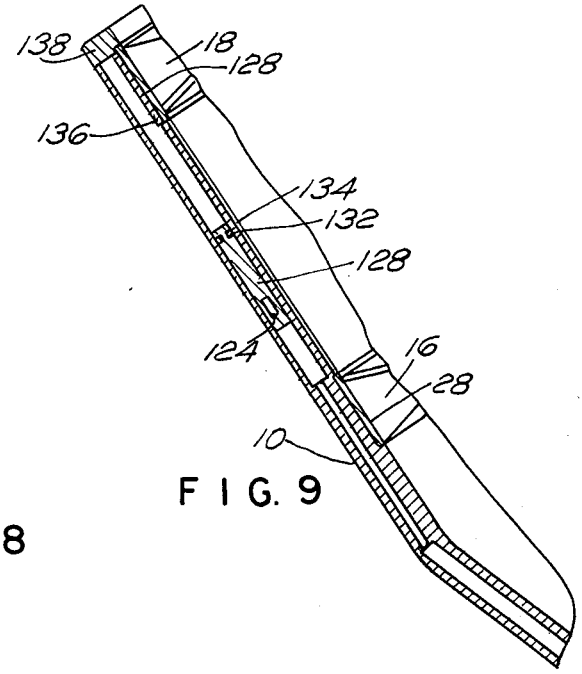
FIG. 9 is a sectional view emphasizing impeller control components of the present invention taken along the line 9—9 of FIG. 7.
Figure 10:
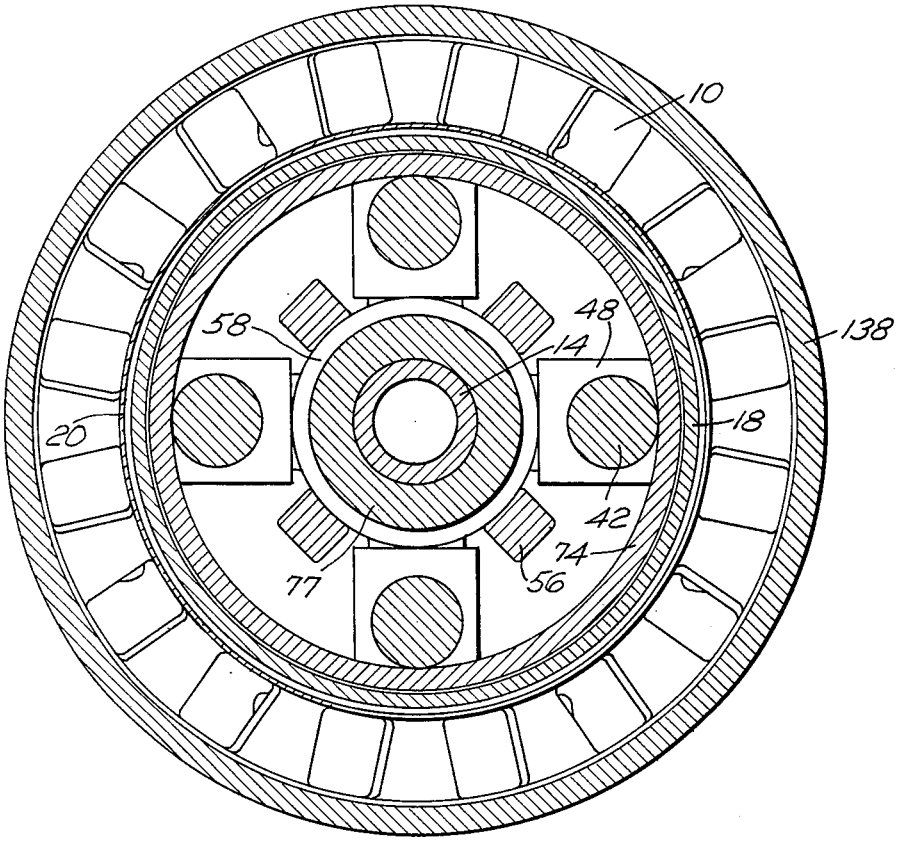
FIG. 10 is a cross-sectional view emphasizing rotating components of the present invention taken along the line 10—10 of FIG. 1.
Figure 11:
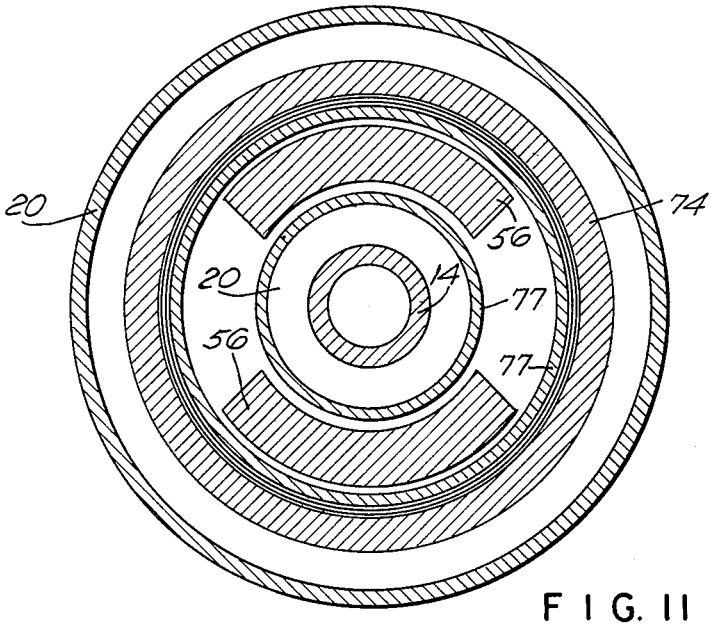
FIG. 11 is a cross-sectional view emphasizing control of rotating components of the present invention taken along the line 11—11 of FIG. 1.

The last remaining control system is illustrated by FIGS. 7, 8 and 9. It constitutes a specially designed leaf spring 124 that is pivoted about pin 126 and activated in either direction by piston 128 under the applied force of positive or negative hydraulic pressure to cylinder cavity 130. The cylinder cavity 130 is machined in outer housing 10 and sealed by O-ring 132. Pivotal leaf spring 124 is interlaced with the two outer impeller bushings 28 such that by cam action one bushing 28 tightens about one impeller 16 or 18 while loosening the other bushing 28 about the other impeller 18 or 16 thereby reducing friction forces about the respective impeller 18 or 16. Separator sleeve 134 and outer bushing 136 which is restrained by loading ring 138 are included in the design to provide adequate assembly feasibility while alleviating possible manufacturing difficulties.

The operation of the power plant as illustrated in FIGS. 1, 2, 3, 7, 8, 9, 10, 11 and 12 is predicated on bringing the field of the motor 30 up to full speed while the impellers 16 and 18 are stationary. Restraint of at least one impeller 16 or 18 is mandatory in order to prevent idling during start-up. Either the restraint is provided by surrounding seawater (flooded launching tube) or mechanical restraint is required during prelaunch when the system rests in the tube. Upon application of energy to the armature 58 the field accelerates to full speed under no-load conditions and the satellites 38 are driven radially outward by centrifugal force such that arbor 40 contact impeller 16 at location 72 and end roller 42 contacts interim member 74 at location 76. Member 74 then drives impeller 18 through the linkage at spline 78. Because of the heavy centrifugal forces at locations 72 and 76 there will be high frictional forces resulting in high torque values developed at either impeller 16 or 18.

As shown in FIG. 1, satellite arbor 40 is positioned such that radii A and D are equal, and radii C and B are equal. From equation FIG. 13 in Machinery's Handbook by Oberg and Jones, 4th edition, page 843, the ratio of impeller output speed to the input speed of the motor field is readily established. Assume impeller 16 is held stationary ($A=D=6.25''$ and $B=C=1.13''$)

$$R\ (\text{ratio})=1-(A/B)(C/D)=1-(6.25/1.13)(1.13/6.25)-=1-1.0.$$

Now assume impeller 18 is held stationary ($D=A=6.25''$ and $C=B=1.13''$)

$$R\ (\text{ratio})=1-(D/C)(B/A)=1-(6.25/1.13)(1.13/6.25)-=1-1=0.$$

The above states that in the configuration shown holding either impeller 16 or 18 stationary results in zero output of the other impeller. This condition allows the motor 30 to come up to no load speed with minimal power required at the input. A vast amount of kinetic energy proceeds to build up within the field of the motor 30 acting primarily as a high energy flywheel. From then on peak power becomes available from the flywheel with little or no dependence on extra torque or power output from the motor 30.

If positive hydraulic pressure is applied to cylinder cavity 90 moving interim member 74 forward, a new position will be assumed by member 74 as shown in phantom in FIG. 1. The four satellites 38 are compelled to also move forward resulting in the satellites being forced radially inward to a new position as shown in FIG. 1. When this happens D is unchanged ($D=6.25''$), C becomes $C'=1.4''$, A becomes $A'=5.87''$ and B is unchanged ($B=1.13''$). We see from the following equation that if impeller 16 is held stationary $$R(\text{ratio})=1-(D/C')(B/A')=1-(6.25/1.4)(1.13/5.87)-=1-0.86=0.14.$$

This indicates that impeller 18 will rotate at $0.14\times$ speed of the motor field in the same direction of rotation.

Whereas, we see by the following equation that if impeller 18 is held stationary $$R(\text{ratio}) = 1-(A'/B)(C/D) = 1-(5.87/1.13)(1.4/6\ 25) = 1-1.164 = 0.164.$$

This indicates that impeller 16 will rotate at 0.164× speed of the motor field in the opposite direction.

Note that the driving torque for either impeller 16 or 18 must be transmitted through the satellites 38 which are essentially solid shafts. In order to develop a torque at one end of satellites 38 they must experience an equal and opposite reaction torque at the other end, such that releasing both impellers 16 and 18 will result in an equal and opposite torque on each impeller 16 and 18. Both impellers 16 and 18 will finally run at the same speed which will be half the average of the two ratios. That is $$R\ (\text{ratio}) = (0.14+0.164)/4 = 0.076.$$

This indicates that both impellers 16 and 18 will run in opposite directions at 0.076× speed of the motor field. All lower interim speeds are available with infinite resolution depending on the fore or aft position of interim member 74. This is a simplification of a previous design and reduces the resulting net speed of the satellites 38 by a factor of two. The position of interim member 74 is under servo control that can supply specific speeds on demand from an in-water transducer independent of depth.

Figure 6:
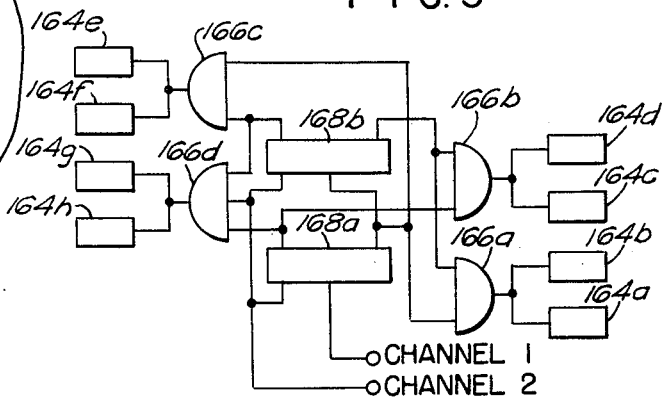
FIG. 6 shows a switching arrangement utilizing the pulsing channels associated with the D.C. motor of FIG. 4.

Since the underwater vehicle is finless, the roll stability is dependent on equal speed of each impeller 16 and 18. Therefore, minor adjustments of the speed of one relative to the other is important. Refer now to FIGS. 6 and 7. The motion of piston 128 fore or aft will place the bushings 28 under reverse loadings such that one will increase the friction at the periphery of one impeller 16 or 18 while the other will decrease the friction at the periphery of the other impeller 18 or 16. Changing minute opposing restraining torques on respective impellers 16 and 18 result in adequate speed variations. Alternate fore and aft positions are monitored by positive or negative hydraulic pressure applied to cavity 130. The position of piston 128 is maintained under servo control by means of an electrolytic "E" pickoff across the longitudinal vertical plane.

Propulsion of the underwater vehicle is dependent on accelerated seawater exiting the annular ring 140 at exit 142. Seawater is directed to impellers 16 and 18 by means of the four ports 144, 146, 148 and 150 which are located in a necked down area where the pressure of fluid flow over the vehicle is noticeably reduce. The port openings 144, 146, 148 and 150 are in line with laminar seawater flow making maximum allowances for freedom of seawater supply to the impellers 16 and 18. The seawater enters the ports and is accelerated in two stages of impellers 16 and 18. The impellers 16 and 18 are amply separated to allow for stabilization of fluid flow between them. The seawater is ejected at annular ring exit 142 imparting the necessary thrust to the vehicle.

Within the respective upper and lower ports 144 and 148 are a pair of baffles 100 hinged by pin 104 and linked by piston 108 with end fitting 110 atached. Positive or negative hydraulic pressure when applied to cylinder cavity 118 will raise or lower the piston 128, closing one baffle 116 while opening the other. Seawater pressure at one baffle 116 will increase causing a decrease in quantity flow, whereas, pressure at the opposing baffle 116 will decrease causing an increase in quantity flow. This operation maintains climb or dive control over the weapon. Continuous monitoring is readily maintained by means of servo control utilizing error data from an electrolytic "E" pickoff 152 in the vertical longitudinal plane of the weapon.

A similar pair of baffles 102 are located in ports 146 and 150 where azimuth control of the vehicle is maintained. Servo control data is supplied by means of electrical error signals from a magnetic north seeking device in the horizontal longitudinal plane of the weapon.

Figure 4:
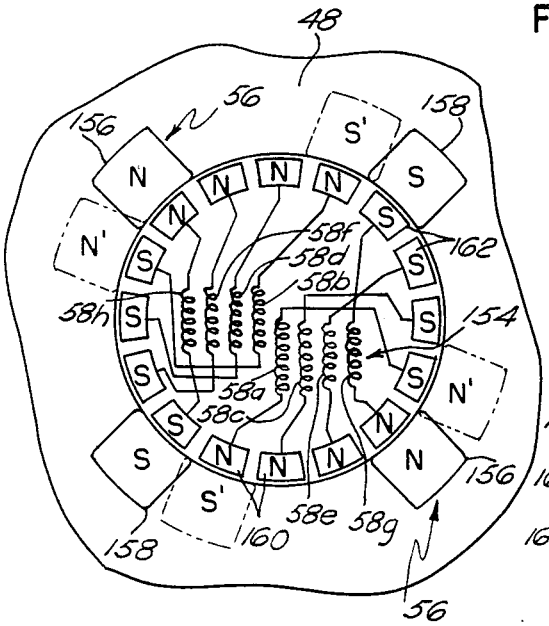
FIG. 4 is a general arrangement of the D.C. motor of FIG. 1 in accordance with the present invention.

The motor 30 includes two permanent magnets 56 in a rotating field produced by a fixed armature 154 containing armature winding coils 58. A schematic arrangement of the magnets 56 and coils **58*a–h* is shown in FIG. 4. Turning in unison with the rotating field is the drum 64 with perforations 66 that pass over two light emitting diodes 68**, generating sixteen and four pulses respectively for each revolution. The sixteen pulses are equally spaced as are the four pulses. Each of the four pulses occur following a set of four pulses from the sixteen pulse sequence.

Referring to FIG. 4 the two magnets 56 in the rotary field create two north poles 156 and two south poles 158 oriented as shown. The eight armature coils **58*a–h* create eight north poles 160 and eight south poles 162**. Since north-south poles attract and north-north or south-south poles repel the field shown would be torqued to rotate counterclockwise to a new position N' and S' whereupon switching the magnetic flux in two coils would be mandated in order to maintain maximum driving torque to the rotating field.

Figure 5:
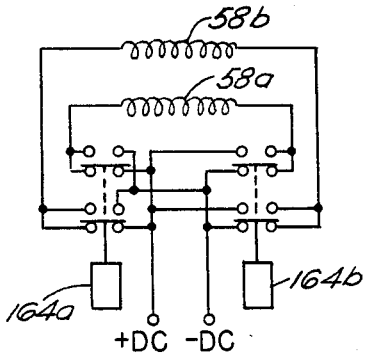
FIG. 5 shows a switching arrangement of the D.C. motor of FIG. 4.

FIG. 5 illustrates two coils **58*a* and 58*b* switched simultaneously from two solid state solenoids 164*a* and 164*b*. The other six relays 58*c–h* would be similarly switched at the proper moment established by the logic circuitry illustrated in FIG. 6. Each coil 58*a–h*** is switched sixteen times for each revolution of the field.

Since there are two channels comprised of perforations 66 and diodes 68 with the first having sixteen pulses and the second four pulses, the switching of solenoids **164*a–h* is accomplished from a band of AND gates 166*a–d* being excited by two set-reset flip-flops 168*a* and 168*b***.

In operation, a pulse from the four pulse channel resets flip-flops **168*a* and 168*b* to zero. The first pulse from the sixteen pulse channel will set both flip-flops 168*a* and 168*b* to the one state opening AND gate 166*a* and triggering solid state relays 164*a* and 164*b*. All relays 164*a–h* remain energized or not energized until retriggered. The second pulse from the sixteen pulse channel will set flip-flop 168*a* to zero state opening AND gate 166*b* thereby triggering relays 164*c* and 164*d*. The third pulse from the sixteen pulse channel will set flip-flop 168*a* to the one state hand flip-flop 168*b* to the zero state triggering relays 164*e* and 164*f*. Finally the fourth pulse from the sixteen pulse channel will set flip-flop 168*a* to the zero state triggering relays 164*g* and 164*b* whereupon both flip-flops 168*a* and 168*b* will be in the zero state. However, a reassurance pulse from the four pulse channel will then occur and reset both flip-flops 168*a* and 168*b*. The reset pulse is necessary just in case an occasional pulse is missed or misinterpreted. Each set of four pulses will retrigger the relays 164*a–h*** resulting in sixteen reversals for each revolution of the field with an additional four reset pulses from the four pulse channel to insure that the system remains on track.

Figure 12:
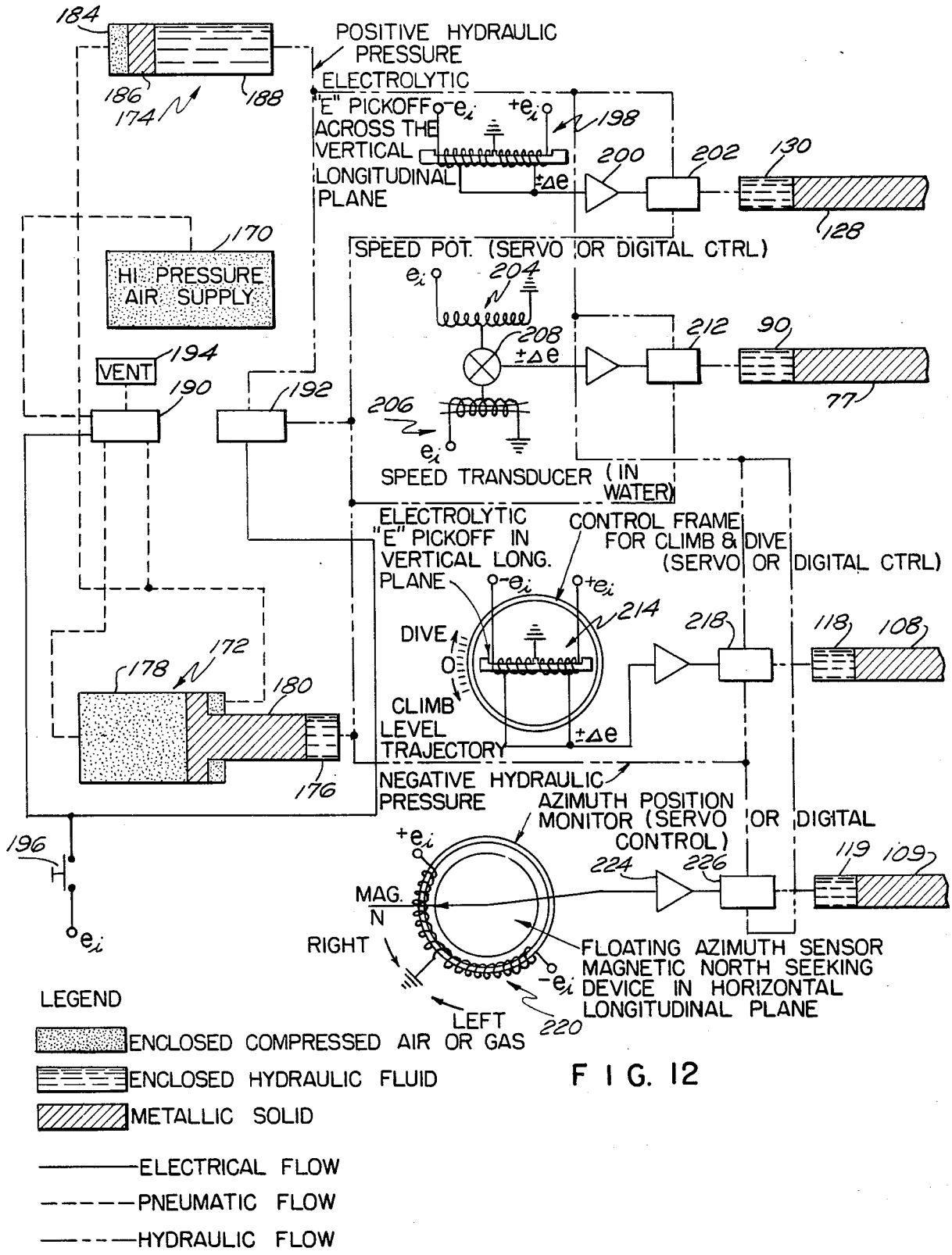
FIG. 12 is a schematic representation of the electro-pneumatic-hydraulic control systems of the present invention.

Refer now to FIG. 12. There is shown a reserve air supply flask 170 and two reserve hydraulic cylinders 172 and 174. Cylinder 172 includes air chambers 176 and 178 for controlling a piston 180. The piston 180 controls the hydraulic fluid in chamber 182. Cylinder 174 includes air chamber 184 for controlling a piston 186. The piston 186 controls the hydraulic fluid in chamber 188. Positive and negative hydraulic pressure is supplied respectively from chamber 188 of cylinder 174 and chamber 182 of cylinder 172. The hydraulic pressure is controlled by the air in flask 170 through four-way two-position solenoid valve 190.

When in operation positive hydrualic pressure supplies fluid to controlling cylinders and negative hydraulic pressure removes fluid from controlling cylinders. The positive and negative hydraulic pressure operate in completely different channels. Neither the reserve air supply flask 170 nor the two reserve hydraulic cylinders are replenished during a verhicle run. Therefore, enough air pressure and hydraulic fluid must be in reserve for at least one run. At the end of each run fluid is manually transferred from hydraulic cylinder 172 to hydraulic cylinder 174 by energizing air valve 190 and hydraulic valve 192. Valve 190 in the normally deenergized state supplies air pressure from flask 170 to chamber 182 of cylinder 172 and chamber 184 of cylinder 174 while venting chamber 178 of cylinder 172 to vent 194. Valve 190 when energized vents chamber 182 of cylinder 172 and chamber 184 of cylinder 174 while supplying pressurized air from flask 170 to chamber 178 of cylinder 172. Hydraulic solenoid valve 192 is two-way two-position. In the normally deenergized position valve 192 maintains separation of the negative and positive hydraulic fluid supply. In the energized position valve 192 allows the negative pressure fluid in chamber 182 of cylinder 172 to flow into the positive fluid in chamber 188 of cylinder 174. In effect, with valves 190 and 192 energized by a switch 196 the pressure chamber 182 of cylinder 172 and the pressure chamber 184 of cylinder 174 are vented through valve 190 to vent 194. Chamber 178 of cylinder 172 is pressurized from flask 170 through valve 190. Since valve 192 is open the hydraulic fluid in chamber 176 of cylinder 172 empties into chamber 188 of cylinder 174 replenishing the supply of hydraulic fluid for additional runs. However, the air flask 170 replenishment must come from an exterior source since the air passing through vent 194 is not retrievable.

For adequate stability and maneuverability of the vehicle, four separate control systems are dependent on energy from the electro-hydro-pneumatic supply system. These four control systems are self-contained within the vehicle and are automatically monitored by electromechanical servomechanisms.

The first of these systems is a speed change system where the speed of one impeller 16 or 18 is varied compared to the speed of the other impeller 18 or 16. In this speed change system an Electrical "E" pickoff 198 is mounted across the longitudinal vertical axis of the vehicle. If the vehicle rolls counterclockwise a negative electrical error signal is produced and if the vehicle rolls clockwise a positive electrical error signal is produced. These electrical error signals are applied to the input of amplifier 200 which is connected to drive servovalve 202 right or left. Servovalve 202 is also connected to receive both positive and negative hydraulic pressure. The servovalve 202 conducts either positive or negative hydraulic pressure depending on the electrical signal received from amplifier 200. The positive or negative hydraulic pressure is applied to cylindrical cavity 130 for driving piston 128. Negative pressure will decrease the speed of the forward impeller 16 while increasing the speed of the aft impeller 18 in minute quantities. Positive pressure will have the exact opposite effect. In either case the result will be a tendency to reright the weapon. This drives the error signal to a neutral zero output.

The second control system increases or decreases the speed of the system. The control system has a potentiometer 204 set at a predetermined voltage. A transducer 206 is placed in the seawater. The transducer 206 converts the velocity of the seawater to an electrical voltage. The voltage outputs of the potentiometer 204 and transducer 206 are combined at summer 208. When the voltage outputs of potentiometer 204 and transducer 206 are of the same magnitude the summer provides a null output. This indicates the vehicle is at the desired velocity. When the desired velocity is not being attained the transducer 206 produces a voltage larger or smaller than that of potentiometer 204 and the summer 208 receives the signals from the transducer 206 and the potentiometer 204, and sends a difference signal to an amplifier 210. The amplifier 210 is connected to drive a servovalve 212 right or left. Servovalve 212 is also connected to receive both positive and negative hydraulic pressure. The servovalve 212 passes either positive or negative hydraulic pressure depending on the polarity of the electrical signal received from amplifier 210. The positive or negative pressure is applied to cylinder cavity 90 which moves cylinder housing 77 fore or aft depending on which pressure is applied. Cylinder housing 77 positions interim member 74. The interim member 74 is spline coupled to impeller 18 and controls the positions of satellites 38. The repositioning of the four satellites 38 increases or decreases the speed of impellers 16 and 18 thereby increasing or decreasing the speed of the vehicle until the error signal from summer 208 is decreased to zero.

The third control system is for maintaining a level trajectory. An electrical "E" pickoff 214 is mounted in the vertical longitudinal plane of the vehicle within a rotatable frame of reference. The output of pickoff 214 connects to an amplifier 216 that connects to a servovalve 218. The servovalve 218 is connected to receive both positive and negative hydraulic pressure. The hydraulic output of servovalve 218 connects to cylindrical cavities 118 which drive pistons 108 to position baffle plates 100. The system works somewhat similar to the first control system although the servovalve 218 can have its hydraulic lines connecting to either cylindrical cavity 118 or both upper and lower cylindrical cavities 118. The control of the baffle plates 100 cause the vehicle to climb, dive or remain level.

The fourth control system is the azimuth control. An azimuth sensor 220 has a magnetic north seeking device with a coil wound on it to form a potentiometer so that when the vehicle is on target a null is sensed. A pickoff 222 is connected to amplifier 224 that connects to a servovalve 226. Servovalve 226 is connected to receive both positive and negative hydraulic pressure. The servovalve 226 passes either positive or negative hydraulic pressure depending on the polarity of the electrical signal received from amplifier 224. The positive or negative pressure is applied to cylinder cavities 119 which drive pistons 109 to position baffle plates 102. The control of baffle plates 102 is similar to the previous system. In this manner the vehicle maneuvered toward a commanded course until a null is obtained at the output of the potentiometer. The null indicates the vehicle is on target. To change the course of the vehicle the null of the potentiometer is repositioned.

There has therefore been described a vehicle drive system having many improved features over the prior art. These features include overall compactness, less weight, reduction in shaft length between driven members and the prime mover, reduction in the speed ratio required by the satellites and reduction in the number of moving parts. In addition, the entire control system has been simplified from a dual to a single system. This eliminates the possibility of simultaneous application of negative and positive hydraulic pressure to the same cylinder due to overshoot in the necessary switching operations. The single system also eliminates several of the previously required control components. A major improvement is the driving of two counter-rotating impellers from a single set of high speed satellites rather than the two sets previously required while essentially reducing the required speed of the satellites in half. Another major improvement for increasing efficiency is the locating of the porting system in direct line with seawater flow and placing the ports in a necked down streamline area where pressure is noticeably reduced. These design changes give improved performance in a less complex system.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A gearless variable speed transmission comprising:

driving means adapted to be rotated around a common axis at a rotational velocity, said driving means for driving at said rotational velocity;

a plurality of satellites with each of said plurality of satellites arranged in contact with said driving means, each of said plurality of satellites including a shaft with a first contact area at one end and a second contact area at the other end, both said first and said second contact areas having surfaces with variable distances from the shaft axis, each of said plurality of satellites adapted to be rotated on its own axis by the combination of said driving means and friction contact at said first and second contact areas, and each of said plurality of satellites adapted to be rotated around the same segment of said common axis by said driving means at said driving means rotational velocity;

a first impeller abutting said first contact area of each of said plurality of satellites, said first impeller having means for being friction driven by said plurality of satellites;

a second impeller abutting said second contact area of each of said plurality of satellites, said second impeller having means for being friction driven by said plurality of satellites at the same speed but opposite direction as said first impeller; and speed control means adapted to abut said plurality of satellites for controlling the speed of said first and said second impellers.

2. A variable speed transmission according to claim 1 wherein said first and said second impellers are arranged to have said common axis and are displaced from each other along said common axis.

3. A variable speed transmission according to claim 2 wherein said speed control means including a piston having said common axis, said piston adapted to be displaced in a direction along said common axis.

* * * * *